US008512141B2

(12) United States Patent
Pryzby et al.

(10) Patent No.: US 8,512,141 B2
(45) Date of Patent: Aug. 20, 2013

(54) AUDIO FORESHADOWING IN A WAGERING GAME MACHINE

(75) Inventors: Eric M. Pryzby, Skokie, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 1526 days.

(21) Appl. No.: 11/242,630

(22) Filed: Oct. 3, 2005

(65) Prior Publication Data

US 2006/0073881 A1 Apr. 6, 2006

Related U.S. Application Data

(60) Provisional application No. 60/615,498, filed on Oct. 1, 2004.

(51) Int. Cl.
*A63F 9/24* (2006.01)

(52) U.S. Cl.
USPC ..... 463/35; 463/16; 463/30; 463/43

(58) Field of Classification Search
USPC ..... 463/35, 1, 16–22, 30, 40, 43
See application file for complete search history.

(56) References Cited

U.S. PATENT DOCUMENTS

2001/0034264 A1* 10/2001 Berman et al. ..... 463/22
2003/0073491 A1* 4/2003 Hecht et al. ..... 463/35

OTHER PUBLICATIONS

Pinball.Org Adams Family Gold Edition Rule Sheet , http://web.archive.org/web/20040614212839/http://www.pinball.org/rules/addamsfamilygold.html).*
Internet Pinbal Machine Database: Midway The Addams Family Special Collectors Edition (release date), http://www.ipdb.org/machine.cgi?id=21.*

* cited by examiner

*Primary Examiner* — Dmitry Suhol
*Assistant Examiner* — Alex F. R. P. Rada, II
(74) *Attorney, Agent, or Firm* — Schwegman Lundberg & Woessner, P.A.

(57) ABSTRACT

A computerized wagering game system has a gaming module comprising a processor and gaming code which is operable when executed on the processor to conduct a wagering game on which monetary value can be wagered, and an audio module operable to use audio to foreshadow game events. The buildup and excitement of playing a wagering game system is enhanced by providing audio clues or audio foreshadowing as to the results of a wagering game event. Examples include playing subtle sounds, playing different sounds, playing sounds at different volumes such as with volume an increasing volume level, or providing other audio cues as to the outcome of a wagering game event.

12 Claims, 4 Drawing Sheets

AUDIO FORESHADOWING IN A WAGERING GAME MACHINE

RELATED APPLICATION

This application claims priority under 35 U.S.C. 119(e) from U.S. Provisional Application Ser. No. 60/615,498 filed 1 Oct. 2004, which application is incorporated herein by reference.

FIELD OF THE INVENTION

The invention relates generally to wagering gaming systems, and more specifically to a wagering game machine employing audio foreshadowing.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever.

BACKGROUND OF THE INVENTION

A wide variety of gaming devices are now available to gamers and to casino operators in computerized form, from slot machines to games that are traditionally played live such as poker and blackjack. These computerized games provide many benefits to the game owner and to the gambler, including greater reliability than can be achieved with a mechanical game or human dealer, more variety, sound, and animation in presentation of a game, and a lower overall cost of production and management.

Computerized video game systems must be designed with many of the same concerns as their mechanical and table game ancestors—they must be fair, they must provide sufficient feedback to the gamer to make the game fun to play, and they must meet a variety of gaming regulations to ensure that both the machine owner and gamer are honest and fairly treated in implementing the game. Further, they must provide a gaming experience that is at least as attractive as the older mechanical gaming machine experience to the gamer, to ensure success in a competitive gaming market.

Many computerized wagering game systems have a variety of sound and graphical elements designed to attract and keep a game player's attention, such as sound effects, music, and animation. These game presentation features often include a variety of music, sound effects, and voices presented to complement a video presentation of the wagering game on a display.

Wagering game players typically stand or sit on one side of a wagering game, and interact with the game such as by pushing buttons, pulling levers, and operating a touchscreen. The wagering game system in turn provides feedback to the game player via the display and one or more speakers. The sounds are typically used to indicate the status of a wagering game, such as to play reel spin sounds indicating the reels are spinning or playing a jackpot sound to alert the game player that a jackpot has been won. Some further embodiments use audio to enhance the theme of a wagering game, such as to provide reel spinning noises, frog noises, and water sounds in a fishing-themed wagering game.

But, such sounds can't be used to build suspense, such as where suspenseful sounds are played in movies, because it isn't known what the results of a particular play of a wagering game will be until after the play is initiated. The effects of building suspense and drawing out the surprise of a positive or exciting result are nonetheless desirable, to enhance the game playing experience and make the wagering game more engaging than competitive wagering games.

It is therefore desired to use audio to further enhance the gaming experience in a wagering game machine.

SUMMARY OF THE INVENTION

The present invention provides in one embodiment a computerized wagering game system has a gaming module comprising a processor and gaming code which is operable when executed on the processor to conduct a wagering game on which monetary value can be wagered, and an audio module operable to use audio to foreshadow game events. One embodiment of the invention contributes to the buildup and excitement of playing a wagering game system by providing audio clues or audio foreshadowing as to the results of a wagering game event. Examples include playing subtle sounds, playing different sounds, playing sounds at different volumes such as with volume an increasing volume level, or providing other audio cues as to the outcome of a wagering game event.

DETAILED DESCRIPTION

In the following detailed description of sample embodiments of the invention, reference is made to the accompanying drawings which form a part hereof, and in which is shown by way of illustration specific sample embodiments in which the invention may be practiced. These embodiments are described in sufficient detail to enable those skilled in the art to practice the invention, and it is to be understood that other embodiments may be utilized and that logical, mechanical, electrical, and other changes may be made without departing from the spirit or scope of the present invention. The following detailed description is, therefore, not to be taken in a limiting sense, and the scope of the invention is defined only by the appended claims.

The present invention provides in one embodiment a computerized wagering game system having a gaming module comprising a processor and gaming code which is operable when executed on the processor to conduct a wagering game on which monetary value can be wagered, and an audio module operable to use audio to foreshadow game events. One embodiment of the invention contributes to the buildup and excitement of playing a wagering game system by providing audio clues or audio foreshadowing as to the results of a wagering game event. Examples include playing subtle sounds, playing different sounds, playing sounds at different volumes such as with volume an increasing volume level, or providing other audio cues as to the outcome of a wagering game event.

Figure 1:
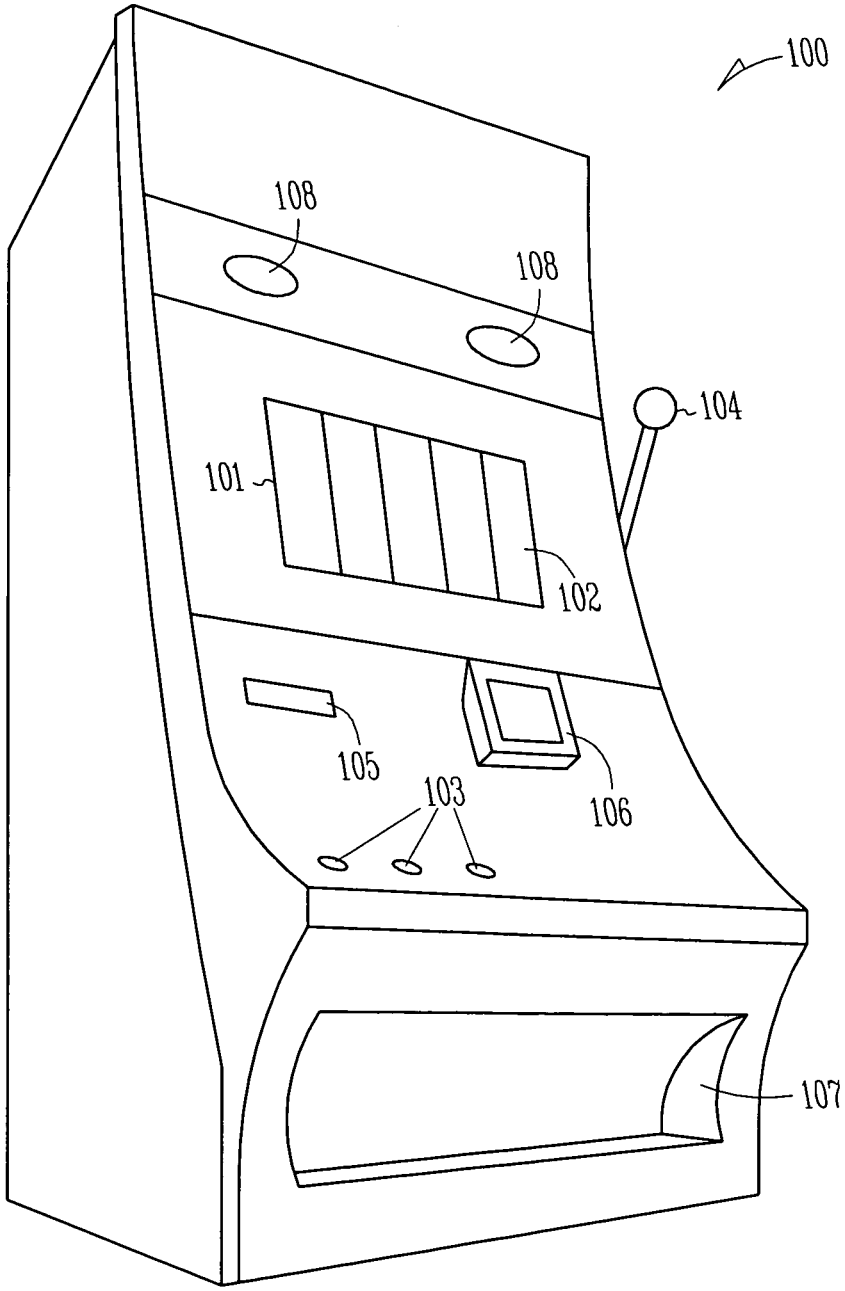
FIG. 1 shows a computerized reel slot gaming system having audio crosstalk cancellation, consistent with an embodiment of the present invention.

An example of such a wagering game system is shown and described in FIG. 1. The computerized gaming system shown generally at 100 is a video wagering game system, which displays information for at least one wagering game upon which monetary value can be wagered on touchscreen video display 101. The touchscreen video display 101 is in various embodiments a CRT display, a plasma display, an LCD display, a field emission display, or any other type of display suitable for displaying electronically provided display information. Further embodiments include alternate or additional displays which may or may not be touchscreen displays, such as a second display located above the primary display, or other displays coupled to the wagering game system. Alternate embodiments of the invention will include other game indicators, such as mechanical reels instead of or in addition to the video graphics reels shown at 102 that comprise a part of a video slot machine wagering game.

A game of chance is implemented using software within the wagering game, such as through instructions stored on a machine-readable medium such as a hard disk drive or nonvolatile memory. In some further example embodiments, some or all of the software stored in the wagering game machine is encrypted or is verified using a hash algorithm or encryption algorithm to ensure its authenticity and to verify that it has not been altered. For example, in one embodiment the wagering game software is loaded from nonvolatile memory in a compact flash card, and a hash value is calculated or a digital signature is derived to confirm that the data stored on the compact flash card has not been altered. The game of chance implemented via the loaded software takes various forms in different wagering game machines, including such well-known wagering games as reel slots, video poker, blackjack, craps, roulette, or hold'em games. The wagering game is played and controlled with inputs such as various buttons 103 or via the touchscreen video display 101. In some alternate examples, other devices such as pull arm 104 used to initiate reel spin in this reel slot machine example are employed to provide other input interfaces to the game player.

Monetary value is typically wagered on the outcome of the games, such as with tokens, coins, bills, or cards that hold monetary value. The wagered value is conveyed to the machine through a changer 105 or a secure user identification module interface 106, and winnings are returned via the returned value card or through the coin tray 107. Sound is also provided through speakers 108, typically including audio indicators of game play, such as reel spins, credit bang-ups, and environmental or other sound effects or music to provide entertainment consistent with a theme of the computerized wagering game. In some further embodiments, the wagering game machine is coupled to a network, and is operable to use its network connection to receive wagering game data, track players and monetary value associated with a player, and to perform other such functions.

Figure 2:
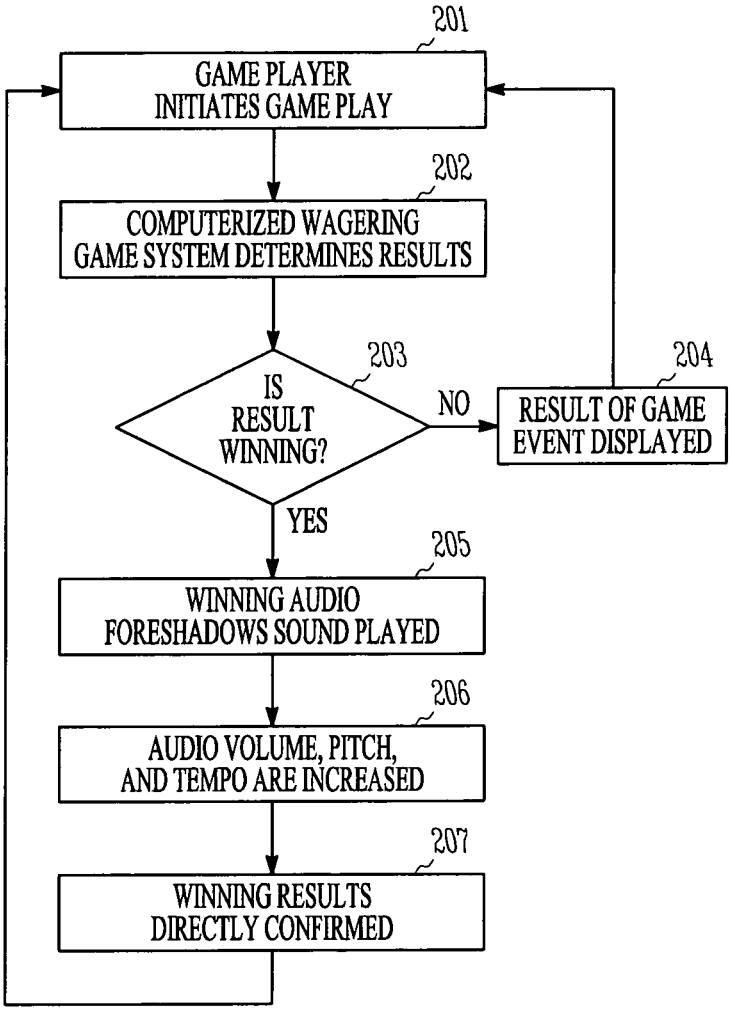
FIG. 2 is a flowchart illustrating using audio foreshadowing to build anticipation before directly confirming a winning result in a wagering game, consistent with an embodiment of the invention.

The results of game events, such as a reel spin in a slot machine game, a roll of the dice in a dice game, or revealing cards in a card game, typically determine the winner of the game and the scope of any prize won. The present invention seeks in various embodiments to add to the excitement of the presentation of wagering game events such as these by foreshadowing the event result with audio before the event is directly confirmed on a video display. In various embodiments, this is achieved by presenting sounds presented only to indicate or foreshadow a certain game result. In other embodiments, the volume, tempo, or pitch of a sound is altered to suggest a certain game result. Such an example is detailed in the Flowchart of FIG. 2, which illustrates one example embodiment of the invention.

A wagering game player selects an amount to be wagered, and initiates a game play at 201. Examples include initiating reel spin with a certain wager in a reel slot machine, or being dealt cards in a video poker machine. The wagering game system then determines, either in the wagering game player's wagering game machine or in another part of the wagering game system, the results of the wagering game at 202. In some embodiments, the wagering game result is determined by a remote server that securely communicates the wagering game result back to the game player's machine for displaying the results to the wagering game player.

If the result is not a winning result at 203, the audio module does nothing out of the ordinary, but continues to monitor the wagering game system results from future instances of game play after the non-winning results are displayed to the game player at 204. Examples include showing a losing hand at video poker, or displaying a non-winning reel slot configuration after reel spin in a reel slot machine.

If the result is a winning result at 203, the wagering game machine uses its audio module, including in various embodiments different combinations of hardware and software configured to provide audible sound to the wagering game player, to play an audio foreshadow sound at 205. As discussed previously, a special sound unique to winning combinations is played in some embodiments to foreshadow a win before the win is directly confirmed such as by displaying the game result on the display, while other embodiments don't change the sound effects or songs that are played but instead vary their volume or some other attribute of the sound. In this example, the audio volume, pitch, and tempo are all subtly and gradually increased at 206, which continues for a period of a fraction of a second to several seconds before the result of the wagering game is directly confirmed.

At 207, the audio foreshadowing has become noticeable enough to strongly suggest that the outcome of the wagering game event is favorable, both through variation from the sound effects or music normally played and from an increase in pitch, tempo, and volume. The results of the wagering game are therefore confirmed directly to the user at 207, such as by showing or highlighting the winning payline or cards on the display or by sounding a siren or "banging up" credits into the wagering game player's credit count.

In other embodiments, music or other sounds are increased in volume, played faster, or played at a higher pitch to build excitement regarding the outcome of the wagering game event. In yet another example, a sound leading up to a game result is played for a longer than usual time to suggest a more favorable result, such that excitement builds more the longer the sound is played.

The sounds in some embodiments of the invention will suggest a specific result, such as a spectator at a craps table calling a slang name for the number rolled. In other embodiments, the sounds themselves are not unique, but the number, volume, or other characteristic of the sounds will suggest a result of the wagering game event.

The presentation of sound that foreshadows the result of a wagering game event is based on predetermined knowledge of the event, making some embodiments of the invention particularly well-suited for use in computerized wagering games where the visual presentation of the wagering game event result occurs after the wagering game result is determined. Predetermination of the result enables the sounds presented before the wagering game event result is displayed visually to be altered in various embodiments of the invention to foreshadow the result.

Figure 3:
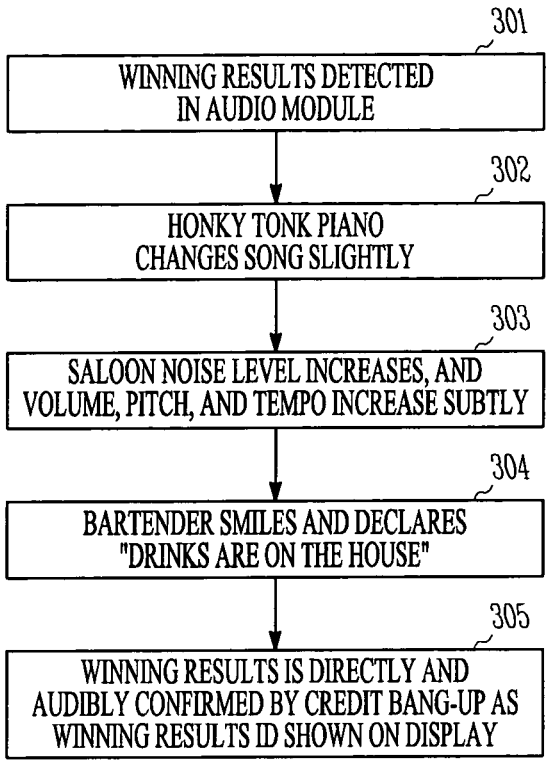
FIG. 3 is flowchart of audio foreshadowing a winning game event in an old west saloon-themed wagering game, consistent with an example embodiment of the invention.

In a more detailed example shown in FIG. 3, a game with an old west theme is implemented. When a winning game outcome is detected in the audio module at 301, a series of changes to the normal audio playback simulating a saloon environment are made. First, the wagering game system makes a slight change in the sound played on a simulated honkytonk piano at 302, such as by adding additional notes, trills, or other sound variation to the played song. The noise of people in the saloon increases slightly and gradually at 303, suggesting a build in excitement in the saloon environment, while in a further embodiment the pitch and tempo of at least one of the honkytonk piano song and saloon noise also increase.

The bartender finally declares "drinks are on the house" at 304, just before the winning result is displayed to the game player at 305, and in some further embodiments further foreshadows the outcome by smiling just before or while saying "drinks are on the house". The winning result is then confirmed at 305, such as by showing the winning hand of cards or showing a winning reel combination, and by playing bang-up sounds as credits are added to the wagering game player's credit bank.

This example shows how theme-specific sounds can be added or modified to employ audio foreshandowing, indicating that an event worthy of celebration is about to occur. It also shows how subtle video changes such as a bartender or dealer smiling can be used to further suggest or foreshadow a positive game result.

Figure 4:
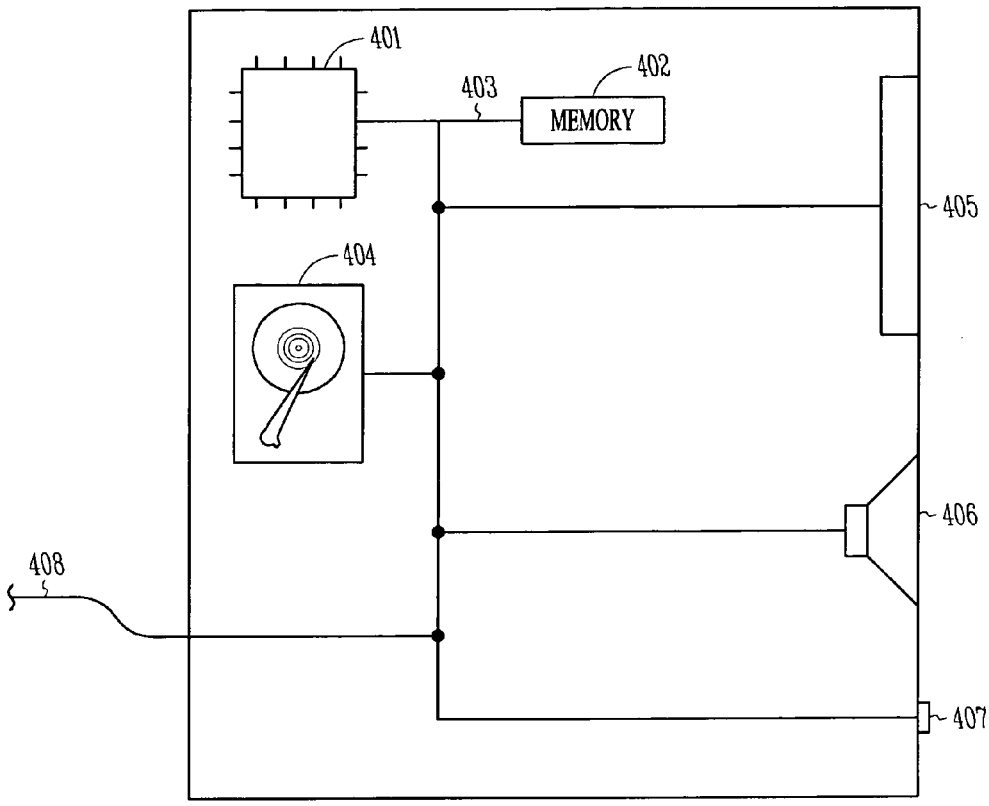
FIG. 4 is a block diagram of a wagering game machine having an audio foreshadowing function and program instructions loaded from a machine-readable medium, consistent with an embodiment of the invention.

Both audio and video are typically controlled by a computerized system within the wagering game machine, using software instructions to control the wagering game machine hardware as shown in FIG. 4. The wagering game system of this example includes a processor 401 and memory 402, coupled by a bus 403. The bus also couples the processor and memory to nonvolatile storage such as hard disk drive 404, or other nonvolatile storage such as flash memory. A touchscreen display panel 405 is used to convey visual information to the wagering game player and to receive input through touches to certain regions of the display, and a speaker 406 is coupled to an audio channel, enabling the wagering game system to play audio such as music and sound effects. User input to the wagering game system is also provided via other hardware such as buttons 406, and network connection 408 couples the wagering game system to other wagering game systems such as to a controller in a progressive slot area network or to an accounting system.

In operation the processor 401 executes software instructions loaded from nonvolatile storage such as hard disk drive 404 into memory 402. The instructions are used to control the hardware, and to perform processes such as causing the wagering game to run and to be displayed on the touchscreen display 405. In some embodiments, the instructions further include instructions for implementing an audio module operable to perform functions such as those described and shown in the flowcharts of FIGS. 2 and 3, and as described in the appended claims. In other embodiments, the audio foreshadowing functions described herein are implemented in some other combination of hardware and software, or in hardware or software alone.

The network connection 408 is used in some embodiments of the invention to receive results of the wagering game, such that the wagering game machine shown generally in FIGS. 1 and 4 doesn't decide the result of the wagering game but receives the result from a central server and displays the result to the wagering game player. The network connection in another embodiment is used to couple or link a group of wagering game machines together for purposes of audio foreshadowing, such as in a progressive slot network version of the previous saloon example in which audio foreshadowing is played on all machines to foreshadow any winning game in the progressive network area. For example, in one such embodiment, the honkytonk piano song change, raise in pitch, raise in tempo, and "drinks are on the house" indicators are played on every wagering game machine in the progressive area network every time a game player in the progressive game area wins a jackpot of a certain level, but the volume doesn't increase as much for the special sound effects for the wagering game players other than the winner.

Figure 5:
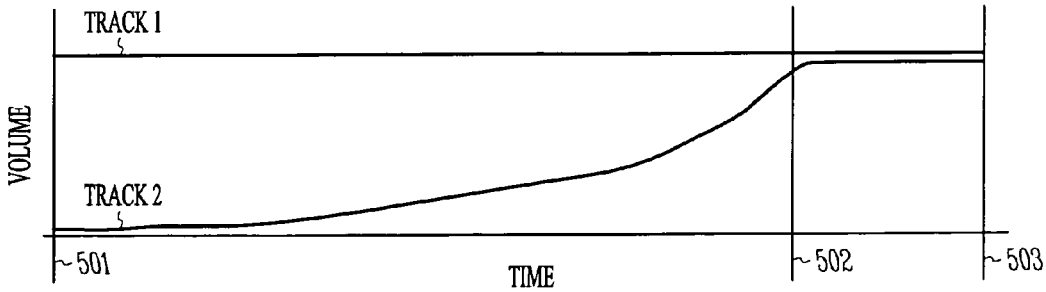
FIG. 5 illustrates an example of progressive variation of sound volume to foreshadow a winning game result

FIG. 5 illustrates an example of progressive variation of sound volume to foreshadow a winning game result. In this continuation of the saloon-themed example, a reel spin is initiated and a winning result is determined at 501. The volume level of some sounds such as reel spin sounds or other system sounds not used for audio foreshadowing remain constant in volume as shown in track 1. The volume level of the audio foreshadowing elements, including extra notes or other musical changes to the honkytonk piano sound, an increase in the volume level of the crowd in the saloon, and other foreshadowing sounds are gradually increased in volume, as shown by track 2. The volume continues to increase until 502, the time at which the wagering game result is normally displayed to the wagering game player. Here, the wagering game result is delayed, and is displayed or otherwise positively conveyed to the wagering game player at a later time at 503. The full volume audio foreshadowing period of time between 502 and 503 is the time during which it is likely evident that a winning result has occurred, and is in this example the time during which the bartender declares "drinks are on the house" as described at 304 of FIG. 3.

In a further embodiment, other parameters such as tempo, pitch, or the number of instruments or notes in a particular audio track are gradually increased, just as audio volume is shown to be gradually increased in the example of FIG. 5. Because it is desirable in some embodiments to suggest, but not to absolutely confirm to the game player, that a positive result is about to be displayed, the rates of change and subtlety of the changes in audio are desirably controllable to fine degrees, such as via audio topology settings or via other computerized control of the audio playback parameters.

The examples presented here have illustrated how audio foreshadowing can be used to build excitement and anticipation in playing and winning a wagering game. The audio foreshadowing examples give here have also shown how variations in audio can be used to enhance the theme of a wagering game while providing audio foreshadowing, such as having sounds or variations in sound consistent with the wagering game environment or theme. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the example embodiments of the invention described herein. It is intended that this invention be limited only by the claims, and the full scope of equivalents thereof.

The invention claimed is:

1. A computerized wagering game system, comprising:

a gaming module comprising a processor and gaming code which is operable when executed on the processor to present a wagering game on which monetary value can be wagered; and an audio module operable to play at least one audio track selected dependent on the result of a wagering game event upon which monetary value can be wagered, such that playing the at least one selected audio track foreshadows the result of the wagering game event before the result of the wagering game event is visually indicated.

2. The computerized wagering game system of claim 1, wherein the wagering game event comprises a reel spin in a reel slot machine.

3. The computerized wagering game system of claim 1, wherein the wagering game event comprises revealing cards in a card game.

4. The computerized wagering game system of claim 1, wherein the wagering game event comprises revealing a dice roll in a dice game.

5. A method of operating a computerized wagering game system, comprising:

presenting a wagering game on which monetary value can be wagered;

playing at least one audio track selected dependent on the result of a wagering game event upon which monetary value can be wagered, such that playing the at least one selected audio track foreshadows the result of the wagering game event before the result of the wagering game event is visually indicated.

6. The method of claim 5, wherein the wagering game event comprises a reel spin in a reel slot machine.

7. The method of claim 5, wherein the wagering game event comprises revealing cards in a card game.

8. The method of claim 5, wherein the wagering game event comprises revealing a dice roll in a dice game.

9. A non-transitory machine-readable medium with instructions stored thereon, the instructions when executed operable to cause a computerized wagering game system to:

present a wagering game on which monetary value can be wagered;

play at least one audio track selected dependent on the result of a wagering game event upon which monetary value can be wagered, such that playing the at least one selected audio track foreshadows the result of the wagering game event before the result of the wagering game event is visually indicated.

10. The non-transitory machine-readable medium of claim 9, wherein the wagering game event comprises a reel spin in a reel slot machine.

11. The non-transitory machine-readable medium of claim 9, wherein the wagering game event comprises revealing cards in a card game.

12. The non-transitory machine-readable medium of claim 9, wherein the wagering game event comprises revealing a dice roll in a dice game.

* * * * *